United States Patent [19]

Ahern

[11] 4,122,973

[45] Oct. 31, 1978

[54] LINED CONTAINERS FOR PAINT AND THE LIKE

[76] Inventor: Paul B. Ahern, 32 Stevens Rd., Melrose, Mass. 02176

[21] Appl. No.: 842,274

[22] Filed: Oct. 14, 1977

[51] Int. Cl.[2] ..... B65D 25/16

[52] U.S. Cl. ..... 220/404; 220/72; 220/410

[58] Field of Search ..... 220/63 R, 306, 366, 220/72, 17, 54, 403, 404, 410, 408; 229/14 B; 215/11 B, 11 E

[56] References Cited

U.S. PATENT DOCUMENTS

| | | | |
|---|---|---|---|
| 1,919,537 | 7/1933 | Stock, Jr. | 215/11 B |
| 2,065,293 | 12/1936 | Scudder | 220/404 |
| 2,630,938 | 3/1953 | Burnett | 220/63 R |
| 2,823,399 | 2/1958 | Stewart | 220/404 |
| 2,961,849 | 11/1960 | Hitchcock | 220/17 |
| 3,216,148 | 11/1965 | Amberg | 220/306 |
| 3,285,461 | 11/1966 | Santelli | 220/17 |
| 3,448,888 | 6/1969 | Smith et al. | 220/306 |
| 3,487,989 | 1/1970 | Rausing et al. | 229/14 B |
| 3,583,596 | 6/1971 | Brewer | 220/306 |
| 3,610,455 | 10/1971 | Greenhalgh et al. | 220/63 R |
| 3,659,825 | 5/1972 | Reiter | 220/404 |
| 3,724,711 | 4/1973 | George et al. | 220/17 |
| 3,797,694 | 3/1974 | See et al. | 220/366 |
| 4,026,459 | 5/1977 | Blanchard | 229/43 |

FOREIGN PATENT DOCUMENTS

| | | | |
|---|---|---|---|
| 997,675 | 7/1965 | United Kingdom | 220/63 R |

*Primary Examiner*—William Price
*Assistant Examiner*—Allan N. Shoap
*Attorney, Agent, or Firm*—James E. Mrose

[57] ABSTRACT

Re-use and extended uses of a paint bucket of conventional form and proportions are promoted by disposable thin internal fluid-tight liners vacuum-formed from relatively thick thermoplastic sheet material; each such liner has exceedingly thin bottom and side walls but is self-sustaining in shape because of circular stiffening by a thick upper rim shaped to snap-lock with and overhang the bucket rim and also because of longitudinal stiffening imparted by several inwardly-projecting hemicylindrical ribs disposed along the side walls where they will serve as vents facilitating insertion and removal of the close-fitting bucket liner.

2 Claims, 5 Drawing Figures

LINED CONTAINERS FOR PAINT AND THE LIKE

BACKGROUND OF THE INVENTION

The present invention relates to improvements in disposable liners for containers, and, in one particular aspect, to unique and improved impervious skin-tight plastic liners, for paint buckets and the like, which retain a desired shape despite thinness of side and bottom walls resulting from vacuum-forming from thermoplastic sheet material, and which may be readily inserted into and removed from a container because of venting afforded by side-wall ribs, and which may be releasably snaplocked in place and kept free of drip and pour contaminations by a relatively stiff overhanging rim having several indentations.

It has of course been generally well known to line containers with inexpensive disposable plastic liners, and the common soft flat plastic bags which may be opened and draped over and inside wastebaskets and the like comprise one familiar example. Imperviousness, and ease of cleaning and disposing of contents have been prime considerations, and liquid-proof linings have been provided for such diverse items as foamed-plastic containers (U.S. Pat. No. 3,144,167), garbage pails (U.S. Pat. No. 1,484,606), and drums for chemicals (U.S. Pat. No. 3,167,210). The latter patent, involving closed drums with top filler necks, disclosed fluted ribbing to impart stiffness to side walls of a plastic drum liner, and, in another case (U.S. Pat. No. 3,940,052), the base of a drum liner has been made stiff, and, in a yet further case (U.S. Pat. No. 3,027,444), a liner fitted within a fiber industrial drum has been caused to have progressively increasing thickness from top to bottom. Holes near the upper end of a flexible bag have served to vent a garbage can while it was being lined (U.S. Pat. No. 2,092,969), and a collapsible paint bucket and its liner have both been collapsed in a controlled manner to exclude air as the contents diminished (U.S. Pat. No. 3,173,573). Flexible bags, reinforced with a metal frame and having an upper tie-off, have also been proposed for lining a paint container and sealing a brush in place (U.S. Pat. No. 3,905,476). It has further been known to frictionally fit and hold the rim of a plastic cup lid (U.S. Pat. No. 4,026,459).

Professional decorators routinely employ open-topped metal paint buckets of predetermined sizes to hold desired quantities of paint, and, although such containers are relatively inexpensive, their costs are not negligible, and substitute non-metallic construction material such as paperboard has been introduced in an effort to reduce investments in such items. In accordance with the present teachings, a conventional sturdy metal paint bucket may be used and re-used, over and over again, without need for intermediate cleaning or drying, and without regard for color or other contaminations, by fitting the bucket with a very thin low-cost disposable plastic liner. Although it might at first seem to be a straightforward matter to implement such a concept, there are numerous complications which interfere. For example, the thin pliable-bag type liner, which immediately comes to mind, is bothersome to open, handle and fit in place, and it tends to wrinkle, to sag from its intended position, and to tear and puncture readily. If, on the other hand, the liner is made rather stiff, it tends also to be thicker and more costly to make, and it resists seating and unseating if it is of tight form-fitting proportions. Further, any leakage between the bucket and liner, such as may occur as the result of brush-wiping and dripping, tends to cause the two to adhere and can lead to need for bothersome cleaning to prevent subsequent contaminations and poor fit of other liners.

SUMMARY OF THE INVENTION

The present invention is aimed at creating improved lined containers, for paint and the like, which facilitate set-ups and clean-ups and promote multiple uses of such containers, without entailing great expense. In a preferred embodiment, a sheet of thermoplastic material which is of at least a predetermined thickness is heated and vacuum-drawn to a seamless bucket-like shape of liner wherein an upper rim of substantial thickness encircles a very much thinner frustro-conical sidewall portion, the latter being blended with a substantially flat bottom. Distributed about the sidewall portion, which is otherwise perfectly smooth, are several inwardly-projecting hemicylindrical hollow ribs which run vertically fully from the bottom to the underside of the rim, and these ribs constitute the only irregularities between the external frustro-conical outline of the liner and the internal frustro-conical outline of a paint bucket within which it is to be mated. The vertically-stiffening effects of the ribs complement the circularly-stiffening effects of the upper rim, the latter not only being thicker than the bottom and side walls but also being of a U-shaped cross-section and overhanging the smaller rim of a co-operating bucket by a sufficient amount to preclude leakage under the lining from under the rim. Spaced indentations around the rim serve to lock with a bucket rim and prevent the liner from moving unintentionally once it is fitted into place.

Accordingly, it is one of the objects of this invention to provide novel and advantageous thin plastic liners, for paint pails and the like, which are of low-cost self-sustaining form and which have venting and strengthening ribs facilitating their use.

Another object is to provide a unique and improved disposable skin-tight plastic liner for a container, in which a relatively thick upper rim strengthens the liner circularly and both overhangs and interfits with a container rim.

BRIEF DESCRIPTION OF THE DRAWINGS

Although those aspects of the present invention which are considered to be novel are expressed in the appended claims, further details as to preferred practices and as to further objects and features thereof may be most readily comprehended through reference to the following description when taken in connection with the accompanying drawings, wherein:

BRIEF DESCRIPTION OF THE PREFERRED EMBODIMENTS

Figure 1:
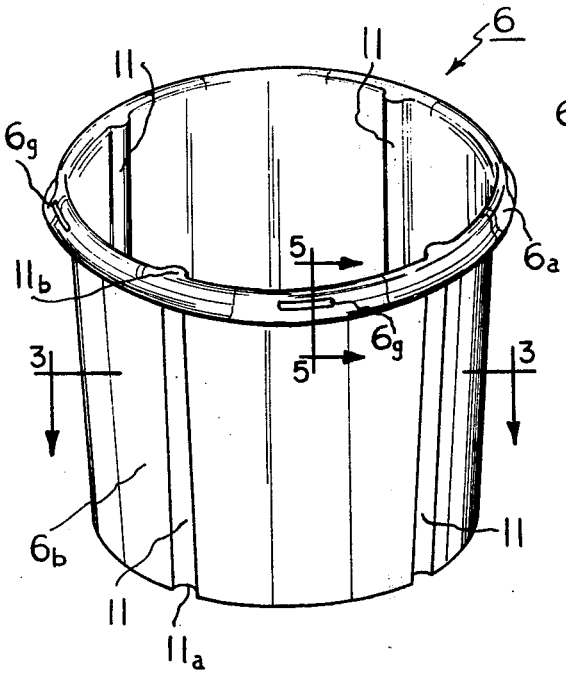
FIG. 1 provides a pictorial view of an improved container liner in accordance with certain of the present teachings.
Figure 2:
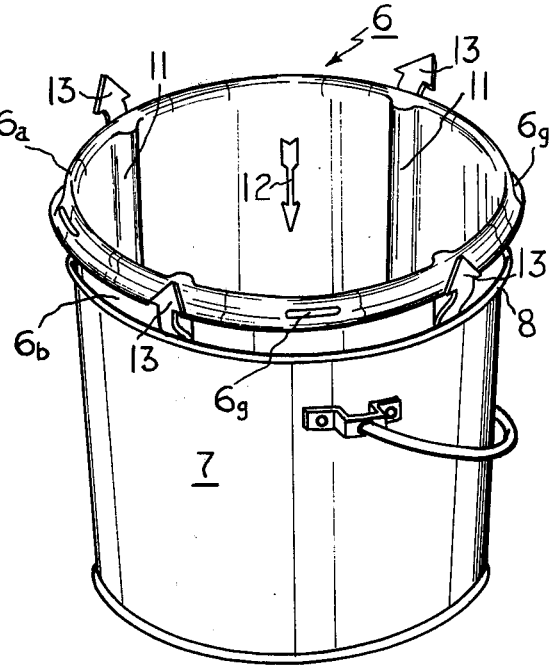
FIG. 2 is a pictorial view of a paint bucket and a cooperating liner of the form shown in FIG. 1, together with arrows representing venting and a direction of relative movement.

Having reference to the drawings, wherein like reference characters designate identical or corresponding components and units throughout the several views, and more particularly to FIGS. 1 and 2 thereof, one embodiment of an improved plastic liner, 6, intended for use with a metal paint pail 7 of conventional form and dimensions, is shown to have a generally frustro-conical configuration. Typically, such a common open five-quart metal paint bucket will have an upper rim diameter of about 8 ½ inches, a lower-end diameter of about 7 ½ inches, an inside depth of about 6 inches, and an outwardly-rolled rim, 8, having about a 3/16 inch diameter. The liner 6 has complementary dimensions, enabling it to mate snugly within the bucket, in skintight relationship except for certain features thereof which are discussed hereinafter.

Figure 3:
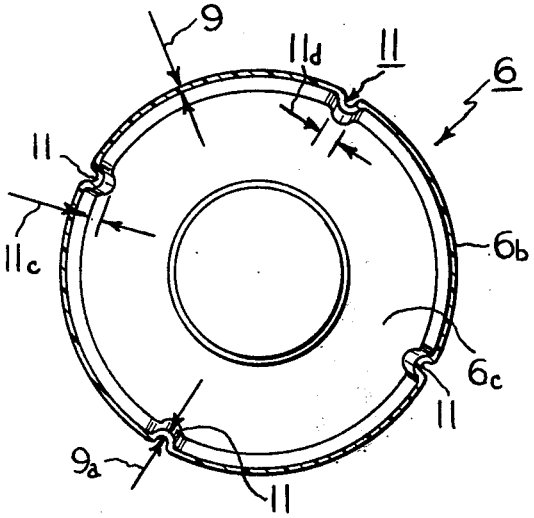
FIG. 3 illustrates a cross-section of the liner, taken along section line 3—3 in FIG. 1.
Figure 4:
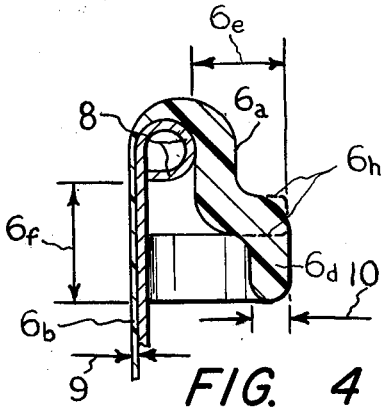
FIG. 4 is a cross-sectional detail of a portion of mated rims of a liner and bucket such as appear in FIGS. 1 and 2.

For purposes of producing a liner which is seamless, somewhat rigid circularly about the top, and sparing of material and related cost, the preferred processing is that of vacuum-forming. In practice of that technique, sheet thermoplastic material of a relatively substantial thickness (such as 0.030 inch) is heated and vacuum-drawn into a mold cavity, with the resulting upper circular rim 6*a* retaining very nearly the same original sheet thickness (such as 0.025–0.030 inch) and the cylindrical side wall 6*b* and substantially flat bottom 6*c* having about 0.005 inch thickness 9 which is only about one-sixth that of the rim thickness 10 (FIGS. 3 and 4). Examples of suitable plastic material are polyethylene, polypropylene, polystyrene and rigid vinyl, and the material may be selected to be clear, translucent, opaque or colored. Thinness of the side wall is perfectly satisfactory, because the lining will then tend to flex into a desirable clinging skin-tight relationship with the bucket interior; however, that same thinness results in structural weakness allowing the side walls to collapse and/or crack easily, and, further, the close air-blocking fit makes it difficult to seat the liner fully into the bucket, or to withdraw it after it has been seated. It is for the latter reasons that several vertical venting ribs 11 are formed at equi-angularly spaced positions around the side wall 6*b*. Four such ribs are shown for the illustrated embodiment, and it should be noted that these project radially inwardly, and that they are of hollow hemicylindrical cross-section, and that they have substantially the same wall thinness, 9*a*, as the thinness 9 of the side wall elsewhere (FIG. 3), and that all of the venting ribs extend fully from the bottom of the pail (11*a*, FIG. 1) to the underside (11*b*, FIG. 1) of the rim 6*a*. Such ribs may be relatively shallow in the radial direction, with a radial protrusion 11*c* of but about ⅛ inch and an arcuate span 11*d* of about ⅜ inch being sufficient to accomplish the intended results in the case of the liner for a five-quart pail under discussion. With such ribs, the side wall 6*b* is advantageously stiffened, in the vertical direction, and a plurality of such liners can be stacked in fully mated relationship with their ribs aligned, for compact storage and shipment. When such a liner, 6, is dropped into a metal paint bucket, 7, and gravitates slowly into place as suggested by arrow 12 in FIG. 2, the entrapped air escapes by way of the vents afforded by ribs 11, as suggested by arrows 13, and the liner will therefore settle into the intended position without remaining raised or requiring hand-pressing into place or leaving creases or wrinkles. Similarly, when such a liner has once been dropped in place, it may thereafter be readily lifted from the bucket, with or without some contents which may remain in the liner, inasmuch as air will be drawn in through the venting ribs to allow the skin-tight bottom and side walls to pull away from the interior of the bucket.

A conventional bead or rim 8 about the top of a paint bucket is rolled in the radially outward direction, and the relatively stiff and thick rim 6*a* of a liner is intended to seat upon the bucket rim and to cover it. Rim 6*a* not only has the aforementioned 6:1 ratio of thickness in relation to side wall thickness but is also drawn downwardly, to fit about the bucket rim 8, and thence outwardly and again downwardly, at 6*d* (FIG. 4), such that it overhangs bucket rim by a significant radial distance 6*e* and a significant axial distance 6*f*, which may be about ⅛ inch and ¼ inch, respectively. The outwardly-and-downwardly extending folded-back rim 6*a* effectively prevents drippings from brush wipings and pourings, from leaking between the liner and bucket, where their presence would defeat purposes of the lining. Distances such as those mentioned suffice to prevent capillary and other surface-tension effects from drawing paint or other liquid contents between the bucket rim and the liner.

Figure 5:
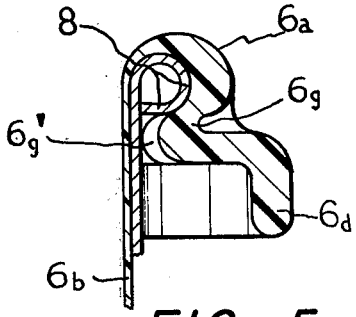
FIG. 5 is a cross-sectioned detail of another portion of mated rims of a liner and bucket, taken at an indentation position such as that designed by section line 5—5 in FIG. 1.

It is also preferred that the liner be held secure against unintended separation from the bucket, as might occur during pouring because the venting ribs will allow the liner to fall out readily, and that it be restrained against unintended angular movement, such as might occur during stirring and/or brush wiping as the inwardly-projecting venting ribs are encountered. Such needs are satisfied by incorporating several equally-spaced arcuately-elongated inwardly-directed indentations, 6*g*, into the liner rim 6*a*. As is shown in FIG. 5, such indentations protrude inwardly, at 6*g*, just below the level at which a metal bucket rim is to be encountered, and the somewhat flexible liner rim 6*a* must flex outwardly to accommodate the snap-fitting of those indentations as a liner is being pressed fully into place. Once so fitted, the indentations serve to hold the liner frictionally against accidental displacements axially and angularly.

The liner rim 6*a* (FIG. 4) may advantageously be terminated in a radially-extending annular margin, as is represented by dashed-linework 6*h*, rather than in the second downwardly-extending cylindrical margin 6*d*. Trim of excess material following vacuum forming is facilitated when the periphery of the rim extends radially. Drippings from the margin will not be likely to leak between the liner and bucket when spacings such as those already mentioned herein are preserved in the case of the radially-extending margin.

Although the container described in connection with this specification has been that of one size of metal bucket or pail for paint, the same invention may also be practiced with specifically-different containers for other materials. In other sizes, for example, paint containers may have handle ears disposed upwardly very near their rims, and the overhanging plastic liner rim may then be partly interrupted at such sites to afford needed clearance. More numerous venting ribs will of course afford greater axial stiffness, for larger-size liners. Accordingly, it should be understood that the specific embodiments and practices herein described have been presented by way of disclosure rather than limitation, and that various modifications, combinations and substitutions may be effected by those skilled in the art without departure in spirit or scope from this invention in its broader aspects and as set forth in the appended claims.

What I claim as new, and desire to secure by Letters Patent of the U.S., is:

1. A disposable liquid-proof liner nestable closely within a rigid open-topped receptacle of predetermined shape and dimensions having a closed bottom and upstanding side walls terminating in an open upper rim, comprising a one-piece open-topped hollow, thermoplastic body having a closed circular bottom and a thin upstanding tubular side wall of external configuration and dimensions substantially matching those of the interior of a receptacle which it is to line, said thin side wall being capable of flexing into a desirable clinging skin-tight relationship with the interior of said receptable, said thin side wall having stiffness rendering it self-sustaining against tendencies to collapse, said stiffness promoted by several peripherally-spaced venting and stiffening ribs extending substantially vertically and being indented inwardly from said side wall toward the liner interior to form open channels running fully from the bottom of said body to an upper peripheral rim of said body on the exterior thereof, said peripheral rim being substantially annular and somewhat flexible and several times the thickness of said thin side walls to contribute peripheral stiffness to said body and extending outwardly to overlie the upper enlarged receptacle rim, and said peripheral rim having a plurality of indentations protruding inwardly just below the level of the receptacle rim when the body and receptacle are fully mated, said indentations being proportioned to frictionally engage the receptacle rim and thereby hold the body in fixed relationship to a receptacle which it lines.

2. A disposable liquid-proof liner as set forth in claim 1, wherein said body is drawn from a sheet of thermoplastic material having a thickness which is substantially that of said peripheral rim, wherein the side wall of said body has the frustro-conical configuration of the interior of a paint bucket, and wherein the surfaces of said venting and stiffening ribs have substantially cylindrical shaping in cross-section.

* * * * *